US008596756B2

(12) United States Patent
Andrews et al.

(10) Patent No.: US 8,596,756 B2
(45) Date of Patent: Dec. 3, 2013

(54) OFFSET INLETS FOR MULTICOLOR PRINTHEADS

(75) Inventors: John R. Andrews, Fairport, NY (US); Terrance L. Stephens, Molalla, OR (US)

(73) Assignee: Xerox Corporation, Norwalk, CT (US)

( * ) Notice: Subject to any disclaimer, the term of this patent is extended or adjusted under 35 U.S.C. 154(b) by 227 days.

(21) Appl. No.: 13/099,161

(22) Filed: May 2, 2011

(65) Prior Publication Data

US 2012/0281044 A1 Nov. 8, 2012

(51) Int. Cl.
*B41J 2/145* (2006.01)

(52) U.S. Cl.
USPC ..... 347/40

(58) Field of Classification Search
USPC ..... 347/20, 40–43, 71, 84–85
See application file for complete search history.

(56) References Cited

U.S. PATENT DOCUMENTS

| | | | | |
|---|---|---|---|---|
| 3,747,120 | A | 7/1973 | Stemme | |
| 4,455,560 | A | 6/1984 | Louzil | |
| 4,695,854 | A | 9/1987 | Cruz-Uribe | |
| 4,882,595 | A | 11/1989 | Trueba et al. | |
| 5,087,930 | A | 2/1992 | Roy et al. | |
| 5,317,346 | A | 5/1994 | Garcia | |
| 5,436,650 | A | 7/1995 | Kobayashi et al. | |
| 5,666,143 | A | 9/1997 | Burke et al. | |
| 5,899,390 | A | 5/1999 | Arndt et al. | |
| 5,912,685 | A | 6/1999 | Raman | |
| 6,042,222 | A | 3/2000 | Moritz, III et al. | |
| 6,131,827 | A | 10/2000 | Kurita et al. | |
| 6,290,338 | B1 | 9/2001 | Uematsu et al. | |
| 6,450,627 | B1 | 9/2002 | Moynihan et al. | |
| 6,565,195 | B2 | 5/2003 | Blair | |
| 6,669,116 | B2 | 12/2003 | Iwase | |
| 6,806,108 | B2 | 10/2004 | Park et al. | |
| 6,808,254 | B2 | 10/2004 | Sakaida et al. | |
| 7,117,597 | B2 | 10/2006 | Nishida | |
| 7,658,473 | B2 | 2/2010 | Silverbrook | |
| 7,726,590 | B2 | 6/2010 | Von Bacho, III et al. | |
| 7,862,160 | B2 | 1/2011 | Andrews et al. | |
| 2002/0051039 | A1 | 5/2002 | Moynihan et al. | |
| 2004/0135853 | A1 | 7/2004 | Netsu et al. | |
| 2008/0239015 | A1* | 10/2008 | Andrews et al. | 347/68 |
| 2008/0316257 | A1* | 12/2008 | Sakaida et al. | 347/40 |

* cited by examiner

*Primary Examiner* — Matthew Luu
*Assistant Examiner* — Justin Seo
(74) *Attorney, Agent, or Firm* — Maginot Moore & Beck, LLP

(57) ABSTRACT

An inkjet array has been developed that enables inlets for one group of inkjet ejectors to be laterally offset from the nozzles of the inkjet ejectors in the group and also enables inlets for another group of inkjet ejectors to be laterally offset from the nozzles of the inkjet ejectors in the other group. The lateral offset distance increases the distance between the inlets of the two groups to provide a wider bonding area between the two groups and improve the fluidic isolation between the two groups of inkjet ejectors.

22 Claims, 8 Drawing Sheets

OFFSET INLETS FOR MULTICOLOR PRINTHEADS

TECHNICAL FIELD

This disclosure relates to the field of inkjet printing systems, and more particularly, to inkjet printheads configured to eject drops of inks having different colors.

BACKGROUND

Drop-on-demand ink jet printing systems eject ink drops from printhead nozzles in response to pressure pulses generated within the printhead by either piezoelectric devices or thermal transducers, such as resistors. The printheads typically include a manifold that receives ink from an external ink supply and supplies ink to a plurality of pressure chambers. Each pressure chamber is fluidly coupled to the manifold by an inlet and to a nozzle, which is an opening in an external surface of the printing system, by an outlet. On a side of the pressure chamber opposite the fluid path to the nozzle, a flexible diaphragm layer overlies the pressure chamber and a piezoelectric or thermal transducer is positioned over the diaphragm layer.

To eject an ink drop from a nozzle, an electric pulse activates the piezoelectric device or thermal transducer, which causes the device or transducer to bend the diaphragm layer into the pressure chamber. This movement urges ink out of the pressure chamber through the outlet to the nozzle where an ink drop is ejected. Each piezoelectric device or thermal transducer is individually addressable to enable the device or transducer to receive an electrical firing signal. Each structure comprised of a piezoelectric or thermal transducer, a diaphragm, a pressure chamber, and nozzle is commonly called an inkjet or jet. When the diaphragm rebounds to its original position, the ink volume in the pressure chamber is refilled by capillary action of the inlet from the manifold.

Many ink jet printing systems eject drops of various colored inks. The inkjets in the system are configured to enable the differently colored drops to form color images on an image receiving member that is positioned opposite the printing system. In a common embodiment, an inkjet printer is configured to emit drops of a predetermined number of different ink colors onto the image receiving member. Combinations of the various ink colors on the image receiving member generate images with a wide range of colors. Common examples of such systems include cyan, magenta, yellow, black (CMYK) printing systems, as well as systems that use different numbers and colors of inks to generate color images. In some multicolor printing systems, separate printheads exclusively eject ink having only one of the predetermined colors. Other printing systems include a multicolor printhead with separate groups of inkjet ejectors. Each group of inkjet ejectors in the multicolor printhead is fluidly coupled to a manifold that supplies only one of the predetermined colors to the pressure chambers in the group of inkjet ejectors. The added complexity of supplying multiple ink colors to the inkjet ejectors and ensuring that ink of one color does not contaminate ink of another color presents a challenge to the design of multicolor printheads. Consequently, improvements to inkjet ejector isolation in multicolor printheads are desirable.

SUMMARY

In one embodiment, an inkjet array has been developed. The inkjet array includes a body layer defining at least portions of a plurality of pressure chambers, an inlet layer having a plurality of inlets formed through the inlet layer, the inlet layer being bonded to the body layer at a position that enables each inlet in the inlet layer to communicate fluidly with only one pressure chamber in the plurality of pressure chambers, an offset channel layer having a plurality of offset channels formed through the offset channel layer, each offset channel having a first end and a second end, each first end of each offset channel being laterally offset from each second end of each offset channel in the offset channel layer, the offset channel layer being bonded to the inlet layer to position each inlet in the inlet layer proximate only one first end of one offset channel formed in the offset channel layer, and an offset inlet layer having a plurality of offset inlets formed through the offset inlet layer. The offset inlet layer is bonded to the offset channel layer to position each offset inlet in the offset inlet layer proximate only one second end in the offset channel layer to form a continuous fluid path from each offset inlet to only one pressure chamber through only one offset channel and only one inlet.

In another embodiment, a printhead has been developed. The printhead includes a body layer defining at least portions of a plurality of pressure chambers, the pressure chambers being arranged in an array of columns and rows, an inlet layer having a plurality of inlets formed through the inlet layer, the inlets being arranged in an array of columns and rows corresponding to the array of columns and rows in which the pressure chambers are arranged, the inlet layer being bonded to the body layer at a position that enables each inlet in the inlet layer to communicate fluidly with only one pressure chamber in the plurality of pressure chambers, an offset channel layer having a plurality of offset channels formed through the offset channel layer, each offset channel having a first end and a second end, each first end of each offset channel being laterally offset from each second end of each offset channel in the offset channel layer, the offset channel layer being bonded to the inlet layer to position each inlet in the inlet layer proximate only one first end of one offset channel formed in the offset channel layer, and an offset inlet layer having a plurality of offset inlets formed through the offset inlet layer, the offset inlets being arranged in columns and rows, the offset inlet layer being bonded to the offset channel layer to position a first column of offset inlets on a first side of each column of inlets in the inlet layer and a second column of offset inlets on a second side of each column of inlets in the inlet layer. Each offset inlet is proximate only one second end of an offset channel in the offset channel layer to form a continuous fluid path from each offset inlet to only one pressure chamber through only one offset channel and only one inlet. The offset inlets on each side of one of the columns of inlets in the inlet layer are aligned in a plurality of rows that are perpendicular to the column of inlets and the rows of the offset inlets are offset from the rows of inlets formed by parallel columns of inlets in the array of inlets in the inlet layer.

BRIEF DESCRIPTION OF THE DRAWINGS

The foregoing aspects and other features of a multicolor inkjet ejector array and printhead are explained in the following description, taken in connection with the accompanying drawings.

DETAILED DESCRIPTION

Figure 1:
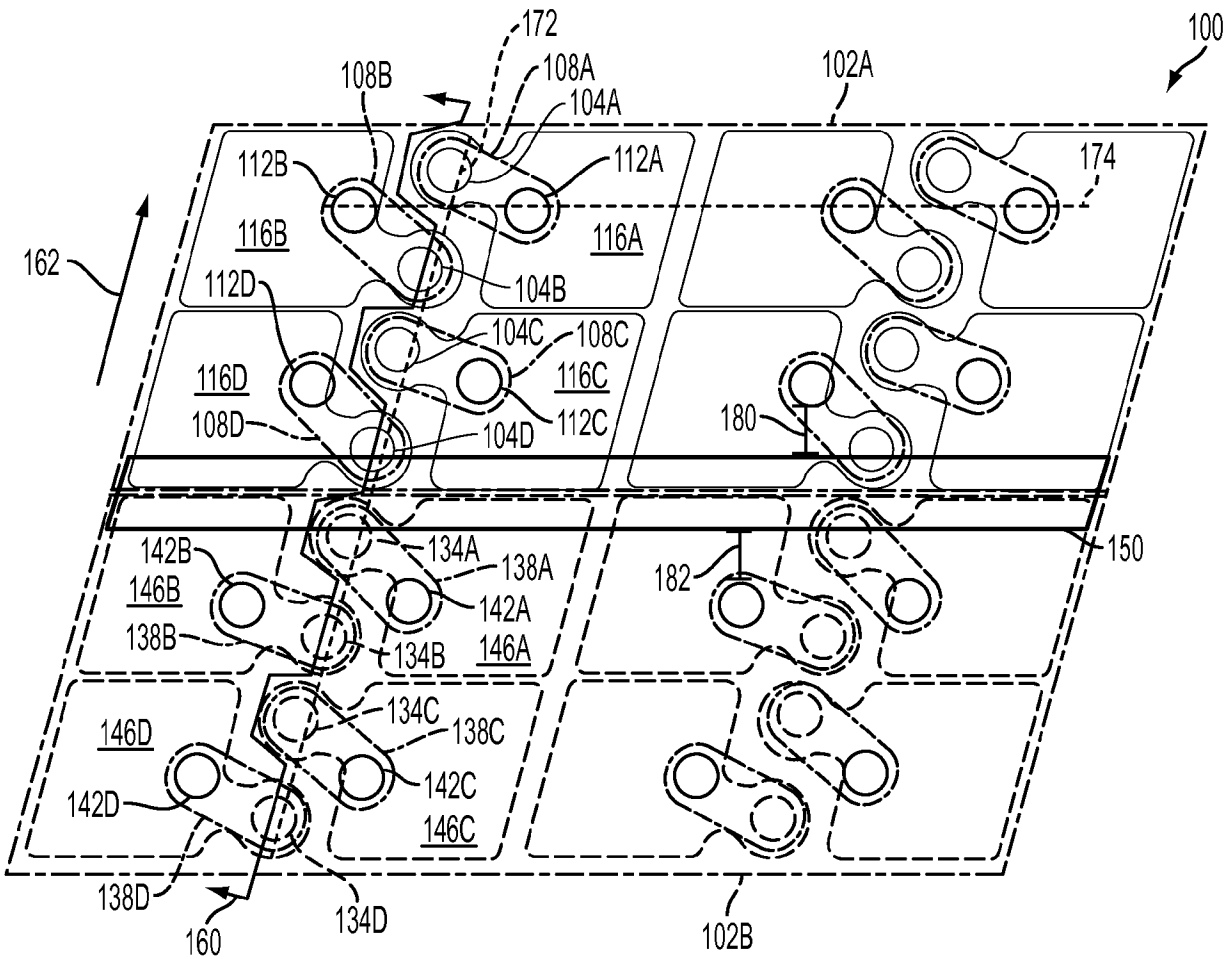
FIG. 1 is a partial view of an array of inkjet ejectors with a first set of inkjet ejectors in the array configured to receive ink having a first color, and a second set of inkjet ejectors in the array configured to receive ink having a second color.

For a general understanding of the environment for the system and method disclosed herein as well as the details for the system and method, reference is made to the drawings. In the drawings, like reference numerals have been used throughout to designate like elements. As used herein, the term "image receiving member" refers to a print medium, such as paper, or may be an intermediate imaging member, such as a print drum or endless belt, which holds ink images formed by inkjet printheads. As used herein, the term "process direction" refers to a direction in which an image receiving member moves relative to one or more printheads during an imaging operation. The term "cross-process direction" refers to a direction that is perpendicular to the process direction along the surface of the image receiving member. As used herein, the term "fluid resistance" refers to a property of a fluid path that resists a flow of fluid through the fluid path. The fluid resistance of the fluid path may be identified by dividing a measured pressure of fluid in the fluid path by the volumetric flow rate of fluid through the path. The fluid resistance of a fluid path may be altered by changing one or more physical dimensions, including length, width, and depth, of the fluid path.

Figure 2:
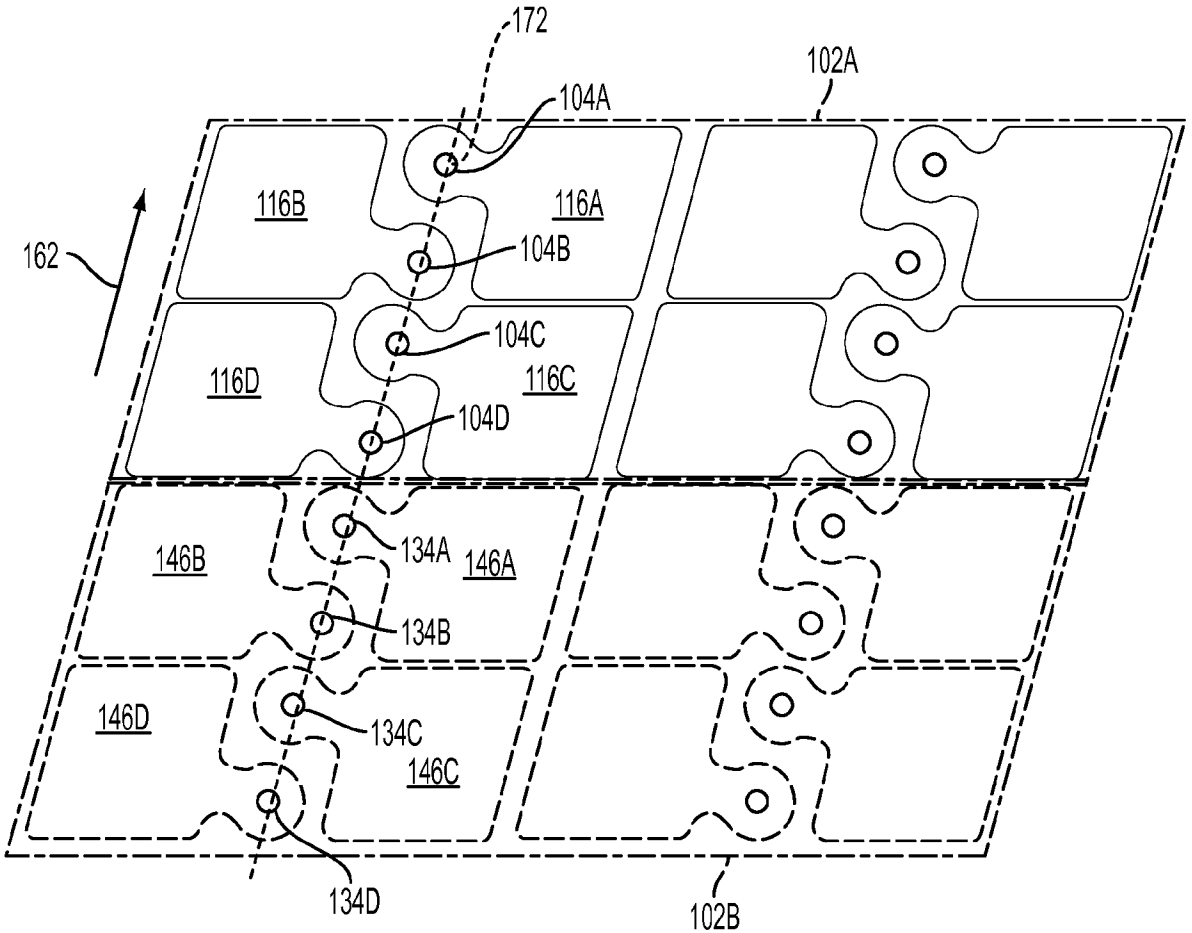
FIG. 2 is a plan view of inkjet ejectors and inlet openings depicted in FIG. 1.
Figure 3:
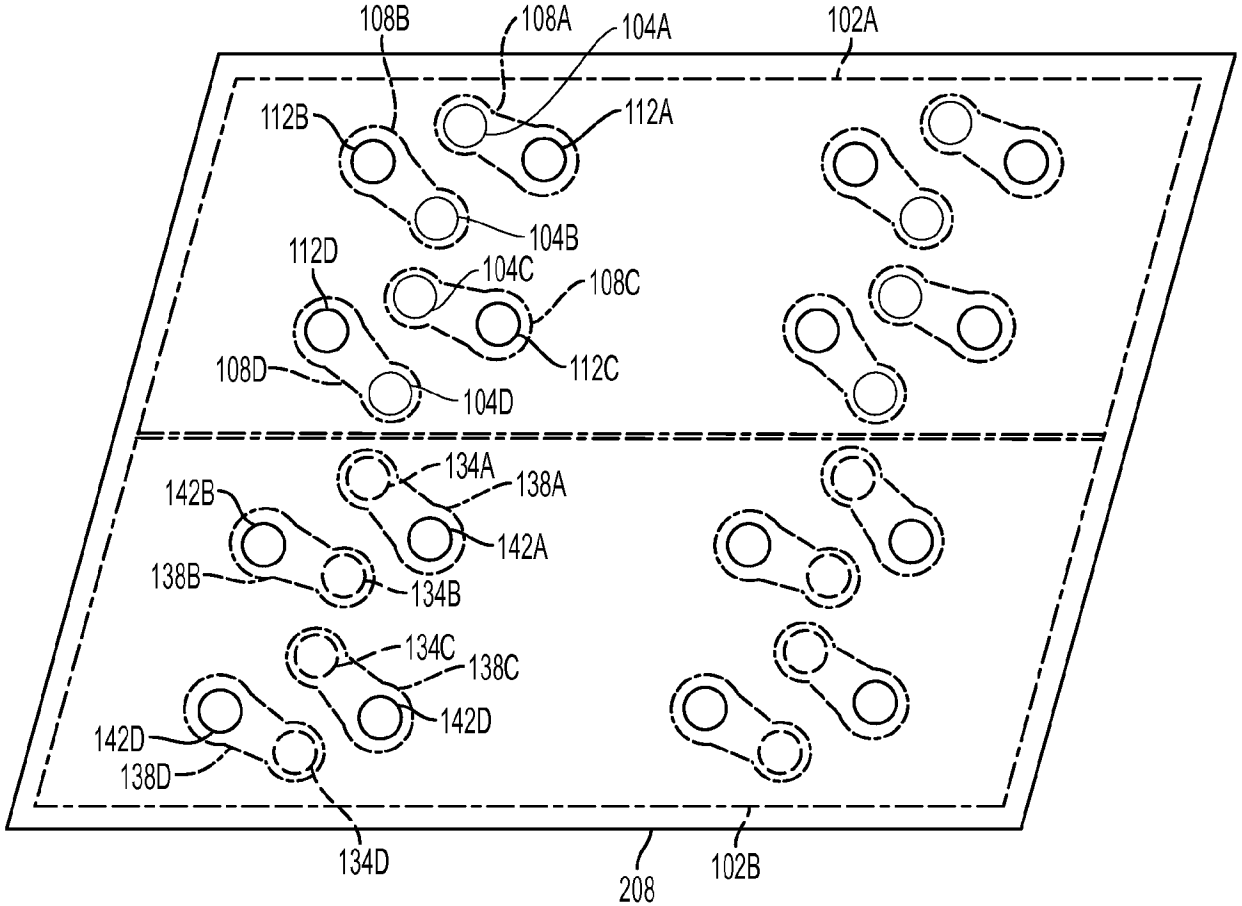
FIG. 3 is a plan view of offset inlet channels depicted in FIG. 1 that are positioned over inlets to the inkjet ejectors depicted in FIG. 2.
Figure 4:
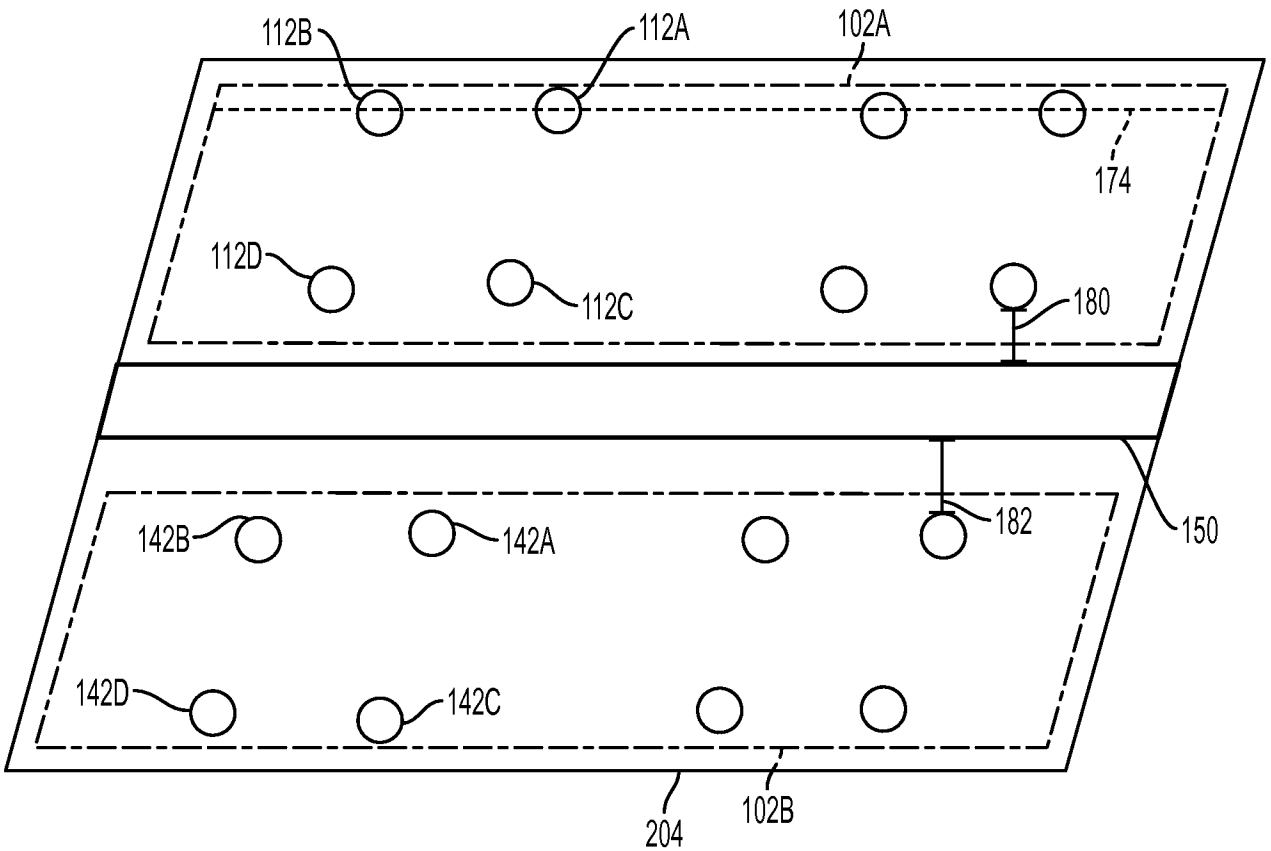
FIG. 4 is a plan view of offset inlet channel openings depicted in FIG. 1 that are positioned over the offset inlet channels depicted in FIG. 3.
Figure 5:
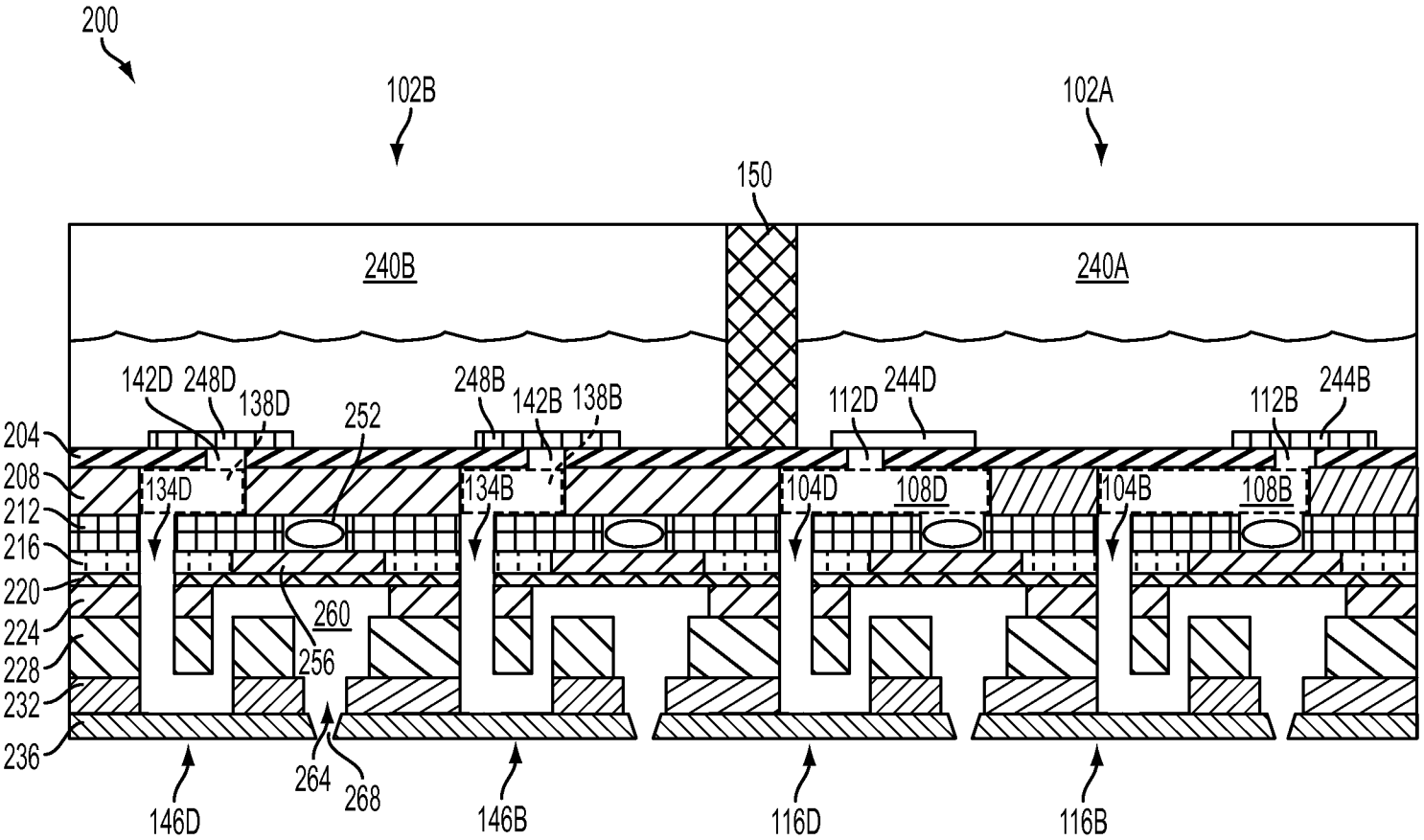
FIG. 5 is a cross-sectional view of a portion of the inkjet ejectors in the inkjet ejector array of FIG. 1 taken along line 160.

FIG. 1 and FIG. 5 depict two inkjet ejector groups that are configured to be fluidly coupled to two ink manifolds that supply different colors of ink. FIG. 1 depicts a top-view of the inkjet ejector groups 102A and 102B that include multiple layers extending into the page that form the inkjet ejectors. The multiple layers depicted in FIG. 1 are shown separately in FIG. 2-FIG. 4. FIG. 2 depicts an array of inkjet ejectors forming ejector groups 102A and 102B. FIG. 3 depicts a layer 208 of inlet offset channels formed above the inkjet ejectors. FIG. 4 depicts a layer 204 of inlet offset openings formed above the inlet offset channels. The inlet offset openings and inlet offset channels enable two or more ink reservoirs to supply different colors of ink to the inkjet ejector groups 102A and 102B.

The inkjet ejector groups 102A and 102B shown in FIG. 1-FIG. 5 are suitable for use in a multicolor inkjet printhead. FIG. 5 is a cross-sectional view of some of the inkjet ejectors depicted in FIG. 1 taken along line 160. FIG. 1 and FIG. 5 depict openings 112A-112D and 142A-142D formed in an offset inlet layer 204. The offset inlet layer 204 is bonded to an offset channel layer 208, that includes offset channels 108A-108D and 138A-138D. The offset channel layer 208 is bonded to an inlet layer 212 that includes inlet openings 104A-104D and 134A-134D. The inlet layer is in fluid communication with the inkjet ejectors 116A-116D and 146A-146D in the ejector groups 102A and 102B, respectively. FIG. 5 depicts the offset inlet layer 204, offset channel layer 208, and inlet layer 212. The reader should understand that some layers, walls, and other opaque structures have been omitted from selected portions of FIG. 1 and FIG. 5 to clarify the structures and fluid paths described below.

FIG. 1 and FIG. 2 depict a plan view of two inkjet ejector groups 102A and 102B that are configured to receive ink from two different ink reservoirs. Each of the inkjet ejectors in the inkjet ejector groups 102A and 102B is fluidly coupled to an ink reservoir, referred to as an ink manifold, with inkjet ejector groups 102A and 102B being fluidly coupled to separate ink manifolds that hold inks having different colors. Each of the inkjet ejector groups 102A and 102B includes a plurality of inkjet ejectors arranged in a predetermined number of rows. The rows are arranged next to one another in process direction 162 and each row extends along the cross-process direction as indicated by line 174. FIG. 1 and FIG. 2 depict inkjet ejector group 102A including inkjet ejectors 116A-116B in one row, with inkjet ejectors 116C-116D in an adjacent row. Similarly, inkjet ejector group 102B includes inkjet ejectors 146A-146B in one row with inkjet ejectors 146C-146D in a second row. While FIG. 1 and FIG. 2 depict inkjet ejector groups that each have two rows of inkjet ejectors, various printhead embodiments may also include one row or three or more rows of inkjet ejectors in each group. The number of inkjet ejectors in each row may vary with respect to the width and density of the inkjet ejector arrays in each printhead.

FIG. 5 depicts a cross-sectional view of a portion of a printhead including inkjet ejectors 116B, 116D, 146B and 146D. The inkjet ejectors are formed from a plurality of layers, including an ink inlet layer 212, an actuator layer 216 that surrounds a plurality of piezoelectric transducer elements 256, a diaphragm layer 220, body layers 224 and 228, an outlet layer 232, and an aperture layer 236. The various layers are bonded to each other in the arrangement shown in FIG. 5 to form the inkjet ejectors.

Referring to inkjet ejector 146D in more detail, fluid ink enters the inkjet ejector through inlet opening 134D. A fluid path formed through the actuator layer 216, diaphragm layer 220, body layers 224 and 228, and outlet layer 232 enables the fluid ink to flow into a pressure chamber 260. The pressure chamber 260 is formed by the body layers 224 and 228 under the piezoelectric transducer 256 and diaphragm layer 220. In operation, an electrical firing signal is transmitted through a flexible, electrically conductive adhesive 252 that is electrically connected to the piezoelectric transducer 256. Piezoelectric transducer 256 is rigidly attached to the diaphragm layer 220. Both the piezoelectric transducer 256 and diaphragm layer 220 deflect the direction of the pressure chamber 260 in response to the electric firing signal. The motion of the diaphragm layer 220 urges ink in the pressure chamber 260 through an outlet 264 and aperture, or nozzle, 268. The ink leaves the inkjet ejector 146D in the form of a drop. After the ink drop is ejected, ink from the manifold 240B flows through inlet 134D to replenish ink in the pressure chamber 260. Each inkjet ejector depicted in FIG. 1 and FIG. 5 has substantially the same structure and operates in the same manner as ejector 146D.

The layers seen in FIG. 5 are illustrative of one inkjet ejector embodiment, and alternative configurations may include a different number of layers and different configurations of fluid paths. For example, while FIG. 5 depicts two body layers 224 and 228, an alternative inkjet ejector configuration may include one body layer or three or more body layers. The fluid path may be arranged in a different configuration than shown in FIG. 5 and may pass through different layers than the example of FIG. 5. Alternative inkjet ejectors including thermal ejectors may also be used. A thermal ejector includes a thermal actuator configured to heat ink in a pressure chamber such as pressure chamber 260. The thermal actuator includes a resistive thermal element, which heats ink in response to an electrical current. The heating forms an expanding gas bubble in the pressure chamber. As the gas bubble expands, ink in the pressure chamber is urged through an inkjet ejector nozzle as an ink drop.

FIG. 5 depicts two ink reservoirs, seen here as manifolds 240A and 240B, which are placed in fluid communication with different groups of inkjet ejectors. While FIG. 5 depicts two manifold reservoirs, various multicolor printheads may include four or more ink reservoirs that are configured to supply inks of various colors to inkjet ejectors. With particular reference to FIG. 4 and FIG. 5, the ink manifolds 240A and 240B are positioned over an offset inlet layer 204 that includes an offset inlet opening corresponding to each inkjet ejector. For example, inlet offset openings 112A and 112B correspond to inkjet ejectors 116A and 116B, respectively.

As seen in FIG. 1, FIG. 3, and FIG. 5, the offset inlet layer 204 is bonded to an offset channel layer 208 that includes a plurality of fluid channels. Each fluid channel in the offset channel layer 208 is fluidly coupled to an offset inlet opening and an ejector inlet opening of a corresponding inkjet ejector. For example, offset inlet opening 142D is fluidly coupled to one end of offset channel 138D, and another end of offset channel 138D is fluidly coupled to the ink inlet 134D of inkjet ejector 146D. Ink from manifold 240B flows through the offset channel 138D and into the inkjet ejector 146D. The embodiment of FIG. 5 further depicts filters 244B, 244D, 248B, and 248D that are positioned over and across offset inlet openings 112B, 112D, 142B, and 142D, respectively. In alternative embodiments, the filters 244B, 244D, 248B and 248D are positioned across and within the corresponding inlet openings to be flush with the offset inlet opening layer 204. The filters enable ink to pass through the respective offset inlet openings while preventing particulates and other solid contaminates from entering inkjet ejectors.

As seen in FIG. 1, FIG. 4 and FIG. 5, a manifold wall 150 separates manifold 240A from manifold 240B. The manifold wall 150 is bonded to the offset inlet layer 204. The surface area of the manifold wall 150 that contacts the offset inlet layer 204 is sufficient to form a seal between manifolds 240A and 240B that prevents an exchange of ink between the manifolds. The manifold wall 150 in the embodiment of FIG. 1 and FIG. 5 has a thickness that extends above of some of the ink inlet openings, including ink inlet openings 104D and 134A. FIG. 1 and FIG. 4 depict an outline of the base of manifold wall 150 to indicate the location where the manifold wall 150 contacts the offset inlet layer 204. FIG. 5 depicts the thickness of the wall 150. As described below, the configuration of the offset inlet layer 204 and offset channel layer 208 enables manifolds 240A and 240B to provide ink to the inkjet ejectors in ejector groups 102A and 102B, respectively, including inkjet ejectors having inlet openings positioned under the manifold wall 150.

Referring to FIG. 1, FIG. 2, and FIG. 5, the inlet layer 212 includes plurality of inlet openings that each enable ink to flow into a body layer in a single inkjet ejector. In FIG. 1, inlet openings 104A, 104B, 104C 104D in inkjet ejector group 102A are fluidly coupled inkjet ejectors 116A, 116B, 116C, and 116D, respectively. In inkjet ejector group 102B, the inlet openings 134A, 134B, 134C, and 134D are fluidly coupled to the inkjet ejectors 146A, 146B, 146C, and 146D, respectively. As seen in FIG. 1 and FIG. 2, the inlet openings 104A-104D and 134A-134D are arranged in a column that is parallel to the process direction 162 as indicated by line 172. Two adjacent inkjet ejectors in each row, such as inkjet ejectors 116A and 116B, have corresponding inlet openings 104A and 104B arranged along the column. This arrangement is repeated in the cross process direction for adjacent pairs of inkjet ejectors in each row.

The distance between each of the ink inlets 104A-104D and 134A-134D is uniform for the ejector groups 102A and 102B. In particular, the distance between inlet port 104D in color group 102A and inlet port 134A in color group 102B is the same as the distances between adjacent ink inlet ports within each of the two color groups. In one example embodiment, the edges of adjacent inlet openings positioned in a column are separated by a distance of approximately 170 μm. The distance between the corresponding inkjet ejectors 116D and 146D is also the same as the distance between adjacent inkjet ejectors in each of the two ejector groups 102A and 102B.

Referring to FIG. 1 and FIG. 5, the offset inlet layer 204 includes a plurality of offset inlet openings exemplified by offset openings 112A, 112B, 112C, 112D, 142A, 142B, 142C, and 142D. A single offset inlet opening is configured to enable ink from a corresponding manifold to enter the offset inlet layer 204, pass through a corresponding ink offset channel, and flow into a corresponding inlet opening for an inkjet ejector. For example, offset inlet opening 112B enables ink in manifold 240A to enter offset channel 108B and flow through inlet opening 104B of inkjet ejector 116B. FIG. 1 and FIG. 5 depict offset inlet openings having a diameter that is approximately equal to the diameter of the inkjet inlet openings, but alternative offset inlet openings may have a different diameter. The offset inlet openings for each row of inkjet ejectors in the ejector groups 102A and 102B are arranged in a row along the cross-process direction 174 and perpendicular to the columns of ink inlets for the inkjet ejectors as indicated by line 172.

The position of each row of offset inlet openings is selected to place the offset inlet openings at a predetermined distance from the manifold wall 150. As seen in FIG. 1 and FIG. 4, the rows of offset inlet openings in inkjet ejector groups 102A and 102B that are closest to the manifold wall 150 are both aligned in parallel to the manifold wall 150 along the cross-process direction parallel to line 174. The distance between each row of offset inlet openings, shown as distance 180 for inkjet ejector group 102A and distance 182 for inkjet ejector group 102B, are substantially equal for both inkjet ejector groups. The distance between the two rows of offset inlet openings is more than twice the distance that separates adjacent ink inlets that are fluidly coupled to inkjet ejectors in different inkjet ejector groups, such as ink inlets 104D and 134A.

As seen in FIG. 1 and FIG. 5, the manifold wall 150 has a thickness that would partially or fully occlude ink inlet openings near the manifold wall, such as ink inlet openings 104D and 134A, if the manifold wall 150 were bonded to the inlet layer 212. The arrangement of the inlet offset openings enables the manifold wall 150 to be bonded to the offset inlet layer 204 without blocking the offset inlet openings such as openings 112D and 142A. The positions of the offset inlet openings and offset channels enable ink to flow from reservoir 240A through opening 112D, offset channel 108D and into inlet opening 104D for printhead 116D. Similarly, offset inlet opening 142A enables ink to flow from reservoir 240B through channel 138A and into inlet opening 134A for printhead 146A.

The offset inlet openings that correspond to each pair of inlet openings in a single column of inlet openings are spaced at substantially equal linear distances from the corresponding inlet openings. For example, offset channels 108A and 108B fluidly couple offset inlet openings 112A and 112B to corresponding inlet openings 104A and 108B, respectively. The linear distance, and consequently the length of the corresponding offset channel, between offset inlet opening 112A and inlet opening 104A is substantially equal to the linear distance between offset inlet opening 112B and inlet opening 104B. The offset channels have substantially equal lengths that enable the offset channels to provide a uniform fluid resistance to ink flowing from a manifold to each inkjet ejector fluidly coupled to the manifold.

As seen in FIG. 1 and FIG. 3, the offset inlet openings are positioned on opposite sides of each column of inlet openings. For example, offset inlet opening 112A is laterally offset to the right of inlet opening 104A along line 174 and offset inlet opening 112B is laterally offset to the left of inlet opening 104B along line 174. The arrangement of offset inlet openings provides a larger magnitude of separation in between adjacent offset inlet openings in each row than between adjacent inlet openings in each column. For example, the separation between offset inlet openings 112A and 112B in a single row seen along line 174 is approximately twice the distance that separates the corresponding inlet openings 104A and 104B in a single column seen along the transverse line 172. The selected arrangement of offset inlet openings that correspond to each row of inkjet ejectors may separate adjacent offset inlet openings in a row by a factor two or more times the distance that separates adjacent inlet openings in each column of inlet openings.

Each pair of corresponding offset inlet openings in the offset inlet layer 204 and inlet openings in the inlet layer 212 are fluidly coupled via an offset channel formed in the offset layer 208. In inkjet ejector group 102A, offset channels 108A, 108B, 108C, and 108D place inlet openings 104A, 104B, 104C, and 104D in fluid communication with manifold 240A via offset inlet openings 112A, 112B, 112C, and 112D, respectively. In inkjet ejector group 102B, offset channels 138A, 138B, 138C, and 138D place inlet openings 134A, 134B, 134C, and 134D in fluid communication with manifold 240B via offset inlet openings 142A, 142B, 142C, and 142D, respectively. Each offset channel includes two ends, with an offset inlet opening positioned at one end and the corresponding inlet opening positioned at the other end. The length and angular offset of each offset channel corresponds to the relative positions of the corresponding offset inlet openings and inlet openings. The offset channels have a width that is wider than the diameters of the offset inlet openings and inlet openings, with the offset channels depicted herein having a width of approximately 200 μm.

Each offset channel presents a fluid resistance to the flow of ink through the offset channel to a corresponding ink inlet. The amount of fluid resistance that the offset channel presents is determined, at least in part, by the length, width, and thickness of the offset channel. As described above, the length and width of the fluid channels are dictated by the relative positions and sizes of corresponding offset inlet openings and inkjet inlet openings. Consequently, the thickness of offset layer 208 may be varied to change the level of fluid resistance through the flow channel. The selected thickness of the offset layer 208 and offset channels changes the level of fluid resistance that each offset channel presents to fluid ink, with the level of fluid resistance being inversely related to the thickness of the fluid channel.

As seen in FIG. 5, the path leading from an ink manifold to each inkjet ejector presents a level of fluid resistance to the fluid as the fluid flows from the manifold to the inkjet ejector. Using inkjet ejector 146D as an example, the inlet path in the inkjet ejector through the ink inlet 134D to pressure chamber 260 presents a predetermined amount of fluid resistance to ink as the ink flows through the inkjet ejector 146D. The offset channel 138D forms a portion of the length of the fluid path from the manifold 240B to the inkjet ejector 146D, and consequently contributes fluid resistance to ink supplied to the inkjet ejector 146D.

A certain degree of fluid resistance aids the operation of the inkjet ejector 146D by preventing ink from flowing through the aperture 268 in the ejector 146D in the absence of a firing signal. If the magnitude of flow resistance is too great, however, the inkjet ejector 146D may not receive a sufficient quantity of ink to eject during an imaging operation, leading to a reduction in image quality and potential damage to the inkjet ejector. Thus, the offset channel 138D is configured to add an amount of flow resistance to the fluid path through ejector 146D that enables the ejector 146D to receive ink at a sufficient rate to eject ink drops during imaging operations.

The thickness of the offset layer 208 is selected so that the proportion of fluid resistance that the offset channel contributes to the fluid path from the manifold 240B to the inkjet ejector 146D is below a predetermined proportion of the total fluid resistance for the fluid path. In the embodiment of FIG. 1 and FIG. 5, the offset channel is configured to contribute less than ten percent of the total fluid resistance of the fluid path. In the selected configuration, the thickness of the offset channel layer is 125 μm. In general, the flow channel contributes a smaller portion of the fluid resistance in the fluid path as the thickness of the flow channel increases. Various other configurations of the flow channel may have different thicknesses to provide a higher or lower proportion of the total fluid resistance.

Figure 6:
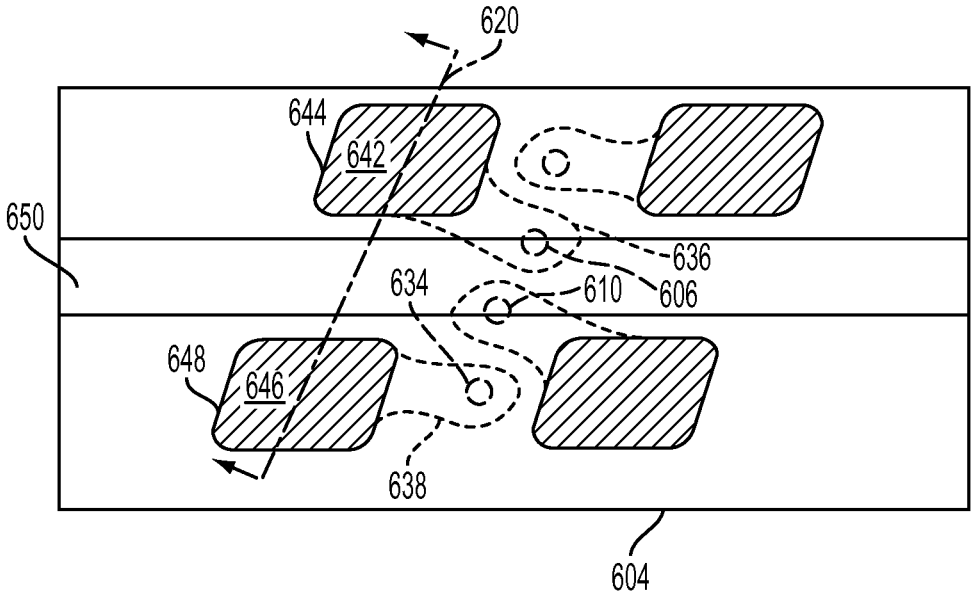
FIG. 6 is a plan view of another configuration of offset channel inlets and offset channels.
Figure 7:
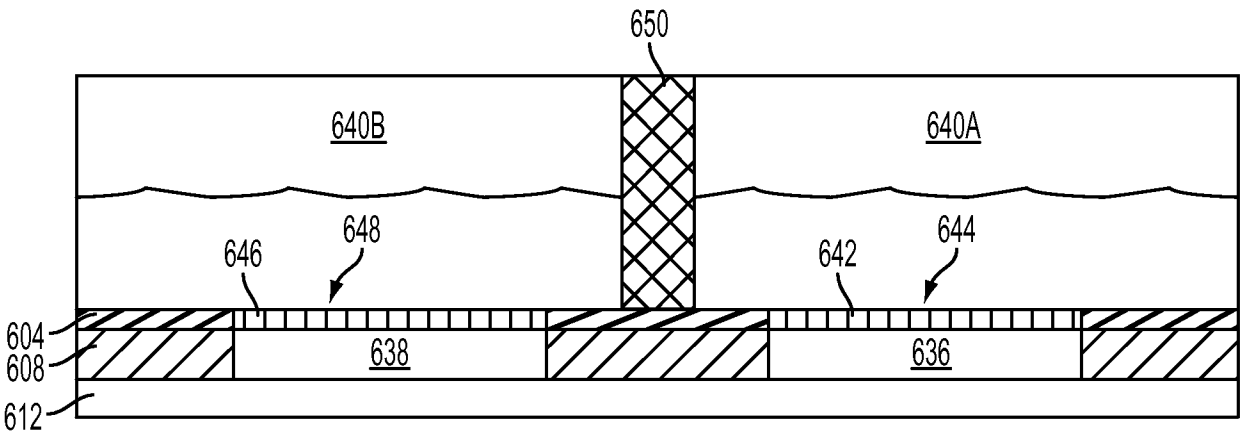
FIG. 7 is a cross-sectional view of a portion of the offset channel inlets and offset channels of FIG. 6 taken along line 620.

FIG. 6 and FIG. 7 depict an alternative configuration of offset inlet channels. In FIG. 6, an offset inlet opening layer 604 is depicted with offset inlet openings 644 and 648 formed over one end of offset channels 636 and 638, respectively. Another end of offset channel 636 is positioned over an inlet opening 606 formed in an inlet layer 612. The inlet opening 606 is fluidly connected to an inkjet ejector. Similarly, offset channel 638 is positioned over ink inlet 634 that is formed through the inlet layer 612. The offset inlet openings 644 and 648 have an approximately quadrilateral shape and are larger in area than corresponding inlet openings 606 and 634 that are positioned at another end of each offset channel. The offset channel inlets 644 and 648 are filled with filters 642 and 646, respectively. The filters 642 and 646 enable ink to flow into a corresponding offset channels and inkjet ejectors and block contaminants suspended in ink from passing through the offset inlet openings.

A wall 650 is positioned between the offset inlet openings 644 and 648 and over a portion of ink inlets 606 and 610. As seen in FIG. 7, the wall 650 is bonded to the offset inlet layer 604 and separates two manifolds 640A and 640B that hold inks having two different colors. FIG. 7 also depicts the filters 642 and 646 as being positioned across the corresponding offset inlet opening 644 and 648 coextensive with the offset inlet layer 604. In one embodiment, the filters 642 and 646 are formed by ablation of a plurality of openings through the offset inlet layer 604 in locations corresponding to the offset inlet openings 644 and 648, respectively.

In operation, the offset inlet opening 644 enables ink in the ink supply 640A to pass through filter 642, flow through offset inlet channel 632, and enter an inkjet ejector through inlet opening 606. The offset inlet opening 648 enables ink in the ink supply 640B to pass through filter 646, flow through offset inlet channel 638, and enter another inkjet ejector through inlet opening 634. The offset inlet openings and offset channels enable the wall 650 to have a sufficient width to separate the inks held in manifolds 640A and 640B while also enabling ink to flow through inlet openings, such as inlet opening 606 and 610 that are positioned under the wall 650. The size and shape of the offset inlet openings and offset channels are selected to enable each of the offset channels to provide a uniform fluid resistance to ink flowing from a manifold to each inkjet ejector fluidly coupled to the manifold.

Figure 8:
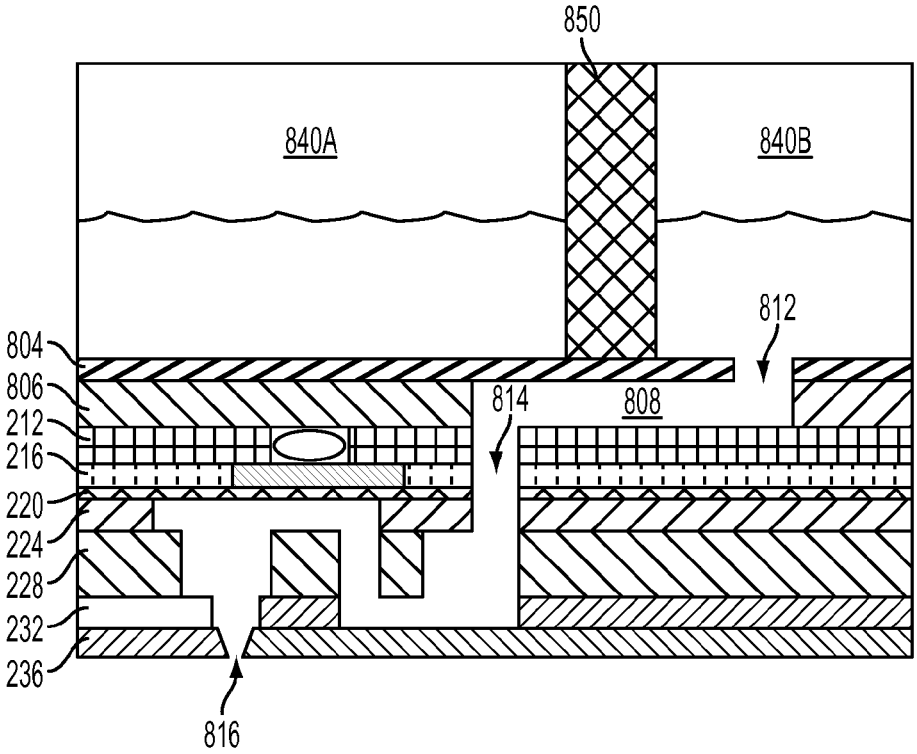
FIG. 8 is a cross-sectional view of an offset channel and inkjet ejector with an inlet to the offset channel positioned on one side of a manifold wall, and an inlet to the inkjet ejector positioned on an opposite side of the manifold wall.

FIG. 8 depicts another alternative configuration of an offset inlet channel 808 and an inkjet ejector 816. Inkjet ejector 816 includes the ink inlet layer 212, actuator layer 216, piezoelectric transducer elements 256, diaphragm layer 220, body layers 224 and 228, outlet layer 232, and aperture layer 236 as described above. In the configuration of FIG. 8, a manifold wall 850 separates two ink manifolds 840A and 840B. The manifold wall 850 is bonded to one side of an offset inlet layer 804, and an opposite side of the offset inlet layer 804 is bonded to an offset channel layer 806. An offset inlet opening 812 formed in the offset inlet layer 804, offset channel 808 formed in the offset channel layer, and inlet opening 814 places the ink manifold 840B in fluid communication with the inkjet ejector 816. The offset inlet opening 812 is positioned on one side of the wall 850 under ink manifold 840B, while the inlet opening 814 that is in fluid communication with the inkjet ejector 816 is positioned on the opposite side of the manifold wall 850 under ink manifold 840A. The offset inlet channel 808 passes under the manifold wall 850 to place the ink manifold 840B in fluid communication with the ink ejector 816 even though the corresponding inlet opening 814 is positioned under the ink manifold 840A.

It will be appreciated that variants of the above-disclosed and other features and functions, or alternatives thereof, may be desirably combined into many other different systems, applications or methods. For example, the positions and sizes of the offset inlets described herein may be varied to accommodate different sizes and configurations of inkjet arrays and manifold designs. Various offset inlet placement configurations may be employed that provide ink to the inkjet ejectors while enabling a manifold wall to seal adjacent ink manifolds. Similarly, the dimensions and angular configurations of the offset channels may be altered to accommodate different inkjet ejector array configurations. Various presently unforeseen or unanticipated alternatives, modifications, variations or improvements therein may be subsequently made by those skilled in the art which are also intended to be encompassed by the following claims.

We claim:

1. An inkjet array comprising:

a body layer defining at least portions of a plurality of pressure chambers;

an inlet layer having a plurality of inlets formed through the inlet layer, the inlet layer being bonded to the body layer at a position that enables each inlet in the inlet layer to communicate fluidly with only one pressure chamber in the plurality of pressure chambers;

an offset channel layer having a plurality of offset channels formed through the offset channel layer, each offset channel having a first end and a second end, each first end of each offset channel being laterally offset from each second end of each offset channel in the offset channel layer, the offset channel layer being bonded to the inlet layer to position each inlet in the inlet layer proximate only one first end of one offset channel formed in the offset channel layer; and an offset inlet layer having a plurality of offset inlets formed through the offset inlet layer, the offset inlet layer being bonded to the offset channel layer to position each offset inlet in the offset inlet layer proximate only one second end in the offset channel layer to form a continuous fluid path from each offset inlet to only one pressure chamber through only one offset channel and only one inlet, the inlets in the inlet layer are aligned in a plurality of linear arrays and the offset inlets in the offset inlet array are arranged in a plurality of linear arrays, adjacent offset inlets in a linear array of offset inlets are separated by a distance that is greater than a distance between adjacent inlets in a linear array of inlets.

2. The inkjet array of claim 1 wherein the distance between adjacent offset inlets in a linear arrays of offset inlets is at least twice as large as the distance between adjacent inlets in a linear array of inlets.

3. The inkjet array of claim 1 wherein the offset inlet and the offset channel in one of the continuous fluid paths add no more than ten percent to a fluid resistance between the inlet and the pressure chamber.

4. The inkjet array of claim 1 further comprising:

for each pair of adjacent inlets in a linear array of inlets, one inlet in the pair is fluidly coupled to an offset inlet on a side of the linear array of inlets that is opposite another side of the linear array of inlets on which the offset inlet fluidly coupled to the other inlet in the adjacent pair is located.

5. The inkjet array of claim 1 further comprising:

a manifold layer in which a plurality of manifolds are formed, the manifold layer being bonded to the offset inlet layer at a position that enables a first group of adjacent offset inlets in a linear array of offset inlets to communicate fluidly with a first manifold in the manifold layer and a second group of adjacent offset inlets in the linear array of offset inlets to communicate fluidly with a second manifold in the manifold layer.

6. The inkjet array of claim 5 wherein the offset inlets in the first group of adjacent offset inlets are spaced from one another by a first distance and the offset inlets in the second group of adjacent offset inlets are spaced from one another by the first distance and one offset inlet in the first group of adjacent offset inlets that is adjacent one offset inlet in the second group of offset inlets are separated from one another by a distance that is greater than the first distance.

7. The inkjet array of claim 1 wherein each offset inlet in one linear array of offset inlets is aligned in a direction perpendicular to the one linear array with each offset inlet in a linear array of offset inlets adjacent to the one linear array of offset inlets.

8. The inkjet array of claim 1 wherein the offset channel layer is at least 75 μm thick.

9. The inkjet array of claim 5 further comprising:

a wall positioned between the first manifold and the second manifold in the plurality of manifolds, the wall being bonded to the offset inlet layer and being parallel to both of the first group of adjacent offset inlets that are fluidly coupled to the first manifold and the second group of adjacent offset inlets that are fluidly coupled to the second manifold.

10. The inkjet array of claim 9, wherein the first group of adjacent offset inlets are separated from the wall by a first predetermined distance and the second group of adjacent offset inlets are separated from the wall by the first predetermined distance.

11. The inkjet array of claim 1, a filter being positioned across an offset inlet in the plurality of offset inlets to enable a fluid ink to flow through the offset inlet and to prevent a contaminant from flowing through the offset inlet.

12. A printhead comprising:

a body layer defining at least portions of a plurality of pressure chambers, the pressure chambers being arranged in an array of columns and rows;

an inlet layer having a plurality of inlets formed through the inlet layer, the inlets being arranged in an array of columns and rows corresponding to the array of columns and rows in which the pressure chambers are arranged, the inlet layer being bonded to the body layer at a position that enables each inlet in the inlet layer to communicate fluidly with only one pressure chamber in the plurality of pressure chambers;

an offset channel layer having a plurality of offset channels formed through the offset channel layer, each offset channel having a first end and a second end, each first end of each offset channel being laterally offset from each second end of each offset channel in the offset channel layer, the offset channel layer being bonded to the inlet layer to position each inlet in the inlet layer proximate only one first end of one offset channel formed in the offset channel layer; and an offset inlet layer having a plurality of offset inlets formed through the offset inlet layer, the offset inlets being arranged in columns and rows, the offset inlet layer being bonded to the offset channel layer to position a first column of offset inlets on a first side of each column of inlets in the inlet layer and a second column of offset inlets on a second side of each column of inlets in the inlet layer, each offset inlet being proximate only one second end of an offset channel in the offset channel layer to form a continuous fluid path from each offset inlet to only one pressure chamber through only one offset channel and only one inlet, the offset inlets on each side of one of the columns of inlets in the inlet layer being aligned in a plurality of rows that are perpendicular to the column of inlets and the rows of the offset inlets being offset from the rows of inlets formed by parallel columns of inlets in the array of inlets in the inlet layer, and the adjacent offset inlets in the first column of offset inlets are separated by a distance that is greater than a distance between adjacent inlets in each column of inlets.

13. The printhead of claim 12 wherein the distance between adjacent offset inlets in the first column of offset inlets is at least twice as large as the distance between adjacent inlets in each column of inlets.

14. The printhead of claim 12 wherein the offset inlet and the offset channel in one of the continuous fluid paths add no more than ten percent to a fluid resistance between the inlet and the pressure chamber.

15. The printhead of claim 12 wherein a first offset inlet in the first column of offset inlets and a second offset inlet in the second column of offset inlets on each side of one of the columns of inlets in the inlet layer are arranged in a row perpendicular to the one column of inlets, the first offset inlet being fluidly coupled to only a first inlet in the column of inlets and the second offset inlet being fluidly coupled to only a second inlet in the column of inlets, the second inlet being adjacent to the first inlet in the one column of inlets.

16. The printhead of claim 12 further comprising:

a manifold layer in which a plurality of manifolds are formed, the manifold layer being bonded to the offset inlet layer at a position that enables a first portion of offset inlets in the first column of offset inlets and a first portion offset inlets in the second column of offset inlets to communicate fluidly with a first manifold in the manifold layer, and a second portion of offset inlets in the first column of offset inlets and a second portion of offset inlets in the second column of offset inlets to communicate fluidly with a second manifold in the manifold layer.

17. The printhead of claim 16 wherein the first portion of offset inlets in the first column of offset inlets are spaced apart from one another by a first distance, the second portion of offset inlets in the first column of offset inlets are spaced apart from one another by the first distance, and a first offset inlet in the first portion of offset inlets is spaced apart from a second offset inlet in the second portion of offset inlets by a second distance, the first offset inlet being adjacent to the second offset inlet in the first column of offset inlets and the second distance being greater than the first distance.

18. The printhead of claim 12 wherein the offset channel layer is at least 75 μm thick.

19. The printhead of claim 16 further comprising:

a wall positioned between the first manifold and the second manifold in the plurality of manifolds, the wall being bonded to the offset inlet layer and being positioned between the first portion of the offset inlets in the first column of offset inlets that are fluidly coupled to the first manifold and the second portion of the offset inlets in the first column of offset inlets are fluidly coupled to the second manifold.

20. The printhead of claim 19, wherein a first offset inlet in the first portion of the offset inlets in the first column of offset inlets that is nearest to the wall is separated from the wall by a first predetermined distance and a second offset inlet in the second portion of offset inlets in the first column of offset inlets that is nearest to the wall is separated from the wall by the first predetermined distance.

21. The printhead of claim 12 having a filter positioned across each offset inlet in the first column of offset inlets and the second column of offset inlets, each filter being configured to enable a fluid ink to flow through an offset inlet and to prevent a contaminant from flowing through the offset inlet.

22. The printhead of claim 12, further comprising:

a wall bonded to a surface of the offset inlet layer that is opposite a side of the offset inlet layer that is bonded to the offset channel layer, the wall having a first side and a second side;

the offset inlets in the first column of offset inlets on the first side of one column of inlets in the inlet layer being laterally offset from the wall on the first side of the wall;

the one column of ink inlets in the inlet layer being laterally offset from the wall on the second side of the wall; and an ink manifold positioned on the first side of the wall and being partially defined by the wall and the offset inlet layer, each offset channel fluidly connecting one offset inlet in the first column of offset inlets to one inlet in the one column of inlets and extending under the wall with the first end of each offset channel being proximate to only one inlet in the column of inlets in the inlet layer and the second end of each offset channel being proximate to only one offset inlet in the first column of offset inlets.

* * * * *